United States Patent [19]

Hamilton et al.

[11] 3,979,862

[45] Sept. 14, 1976

[54] BUILDING STRUCTURE

[75] Inventors: Clive Gordon Hamilton, Brighton; John Norman Horley, Beaumaris; Graham Moss, Knoxfield, all of Australia

[73] Assignee: Gibbs Bright & Co., Australia

[22] Filed: Mar. 21, 1975

[21] Appl. No.: 560,730

[52] U.S. Cl. ..... 52/90; 52/233; 52/574

[51] Int. Cl.[2] ..... E04B 1/10

[58] Field of Search ..... 52/233, 586, 646, 641, 52/93, 90, 574

[56] References Cited

UNITED STATES PATENTS

| | | | |
|---|---|---|---|
| 1,082,937 | 12/1913 | Douglass | 52/641 X |
| 2,403,934 | 7/1946 | Lindstrom | 52/233 |

FOREIGN PATENTS OR APPLICATIONS

| | | |
|---|---|---|
| 425,916 | 7/1972 | Australia |

*Primary Examiner*—Ernest R. Purser
*Assistant Examiner*—Carl D. Friedman

[57] ABSTRACT

A modular building structure is formed of wall sections of superimposed logs, the logs being slightly flattened on their abutting top and bottom sides and having vertically aligned transverse slots in their ends. The flange of a structural stud, such as rigid vertical channel member, is interengaged with the slots to hold the logs in position, and wooden wedges secure the logs to the stud flange. The logs on the sides of the building generally alternate in their thick end--thin end placement to keep the logs fairly level. Some log sections on the ends of the building have a majority of their thick ends positioned toward the center of the structure to accumulate their heights under the higher portions of the building's gabled roof. The roof includes a series of rafters supported on a series of the structural studs. The rafters are in turn connected to one another by generally parallel purlins running the length of the building. Diagonal wind bracing interconnects the rafters and is adjustable in length for squaring, bracing, and securing the building structure. The walls along the length of the building alternate between wall sections and portal sections, the portals being secured directly to the vertical studs at the sides of the portals. An optional feature window assembly may be substituted for a wall section. Half-round and quarter-round logs are strategically located to conceal some of the vertical studs in order to improve the appearance of the building. Architraves around the portals conceal others of the studs and align the superimposed logs at the edges of the portals.

9 Claims, 19 Drawing Figures

BUILDING STRUCTURE

BACKGROUND OF THE INVENTION

This invention relates to log cabins, and more particularly to improvements in a log cabin structure such as disclosed in Australian Pat. No. 425,916 (published July 27, 1972).

The log cabin in Australian Pat. No. 425,916 is a modular structure composed of a series of wall sections, each a vertical series of superimposed logs cut to the same length and of similar diameter. Slots in the ends of the logs are positioned in vertical alignment to receive the flange of a vertical stud member which keeps the logs aligned and in position. The vertical member may be a channel, a right angle, two connected angle sections, or any other appropriate structure, as further disclosed in the Australian patent.

The Australian Patent also shows a series of portals alternating with log sections along the length of the building. The roof is gabled, and the interfaces between the logs, as well as the rest of the structure, are filled with a compressible resilient waterproof plastic material to seal the log cabin against the elements.

Other relevant patents include U.S. Pat. Nos. 1,416,821, 1,510,326, 1,813,455, 2,403,934, 2,619,686, 2,875,478, 3,460,301, Australian Pat. Nos. 116,392, 145,282, 283,101, and British Pat. Nos. 1,115,871, and 1,259,123.

SUMMARY OF THE INVENTION

Briefly, the present invention is directed to improvements in the log cabin structure disclosed in the above-noted Australian Pat. No. 425,916. More specifically, the present invention provides a method and structure for erecting, squaring, bracing, and reinforcing such a log cabin, for substituting a feature window for a section of the wall, for securing a better appearance and a more stable configuration in the log wall sections of the structure, for disguising the structural studs for further improving the appearance, and for providing the log cabin with a gabled roof.

In prior such cabins, the resilient plastic water-proof sealing material between the logs was able, due to its resiliency, to accommodate limited seasonal changes in the dimensions of the structure. However, since the logs were free to move upwardly and downwardly along the stud flanges, the log shrinkage resulting from changes in temperature and humidity accumulated at the top of the wall. That is, due to the weight of the logs, the resilient strips beneath the lower logs remained compressed, and the logs simply shifted downwardly. These changes could exceed the ability of the uppermost strip to accommodate them, causing a gap to open at the top of the wall.

In order to improve the seasonal stability of the present log cabin, wooden wedges are driven into the slots in the logs and against the vertical stud flanges therein. This secures the logs in position on the studs so that their vertical positions remain fixed regardless of changes in the dimensions of the individual logs. Thus the slight dimensional changes which naturally occur from season to season are distributed throughout the height of the wall, and each resilient strip accommodates its proportionate share of the shrinkage and/or expansion. Unsightly gaps do not appear in the wall, and the wall remains weather tight.

Since most logs are naturally tapered, the present invention teaches that the logs in most of the wall sections should be superimposed in generally alternating fashion so that the log ends at a given stud alternate between thick and thin. In this way, the heights of the logs accumulate equally along the length of the wall.

The end walls of the building include three wall sections, the center of which has the alternating log placement just discussed. The two outer wall sections do not follow this pattern, but have the majority of their thick ends located toward the center of the end wall. In this way the heights of the thicker ends of the logs accumulate toward the peak of the gabled roof above the center of the end wall. This causes the higher logs on the two outer sections to acquire a slant in the same direction as that of the gabled roof above, minimizing or eliminating the need to fill irregular spaces between the slanted roof and the uppermost log in these sections.

The roof is constructed of a series of rafters supported on the series of studs and interconnected by generally parallel wooden purlins running from rafter to rafter. Several of the rafters are further interconnected by diagonal wind bracing rods. The studs, rafters, purlins, and wind bracing rods are attached by nuts and bolts which are initially not tightened so that the various members may be shifted and adjusted relative to one another. After this framework is loosely assembled, the wind bracing is tightened to square the structure. That is, the tightening of the wind bracing is done selectively to pull the structure into a squared or rectangular configuration. Due to the modular configuration and the fact that similar members, except for the diagonal wind bracing, are parallel, the entire structure forms a series of interlocked parallelograms. As a result, the entire structure is moved as a whole as the diagonal wind bracing rods are adjusted in length, so that the entire structure is squared at one time. The remaining nuts and bolts are then tightened to rigidify the structure.

A feature window assembly may be substituted for a log section of the log cabin. This is easily done when the studs on either side are channel members. A timber insert is filled into each channel on each side of the section where the window is being substituted, and the window is then directly attached to the timber inserts, as by nailing. The inserts fill the channels to the edges of the channel flanges, and the feature window fills the distance between the timber inserts on either side of the wall section. In this way the feature window traps the timber inserts in the channels, and these in turn hold the feature window assembly in place. Thus there is provided a permanent and secure feature window substitution which requires no modification of the modular structure on which the log cabin is based.

In order to improve even further the already attractive appearance of the log cabin in Australian Pat. No. 425,916, the present invention teaches the use of half-round logs where two log sections abut one another on the end walls of the building. These half-round logs are mounted vertically adjacent the ends of the horizontal logs at the vertical flanges at the ends of each section. The vertical half-round logs cover the visible ends of the logs and conceal the vertical stud to improve the building's appearance.

Australian Pat. No. 425,916 teaches the use of a full-round log in the rectangular space formed between the two interconnected angle sections of the corner studs of the building. In contrast, the present invention teaches the improvement wherein a quarter-round log is mounted into this space. This permits a log with a much larger radius to be used, and the curved surface of the log may therefore be limited to about the same 90° angle which the building turns at each corner. The corner space is thus filled more effectively, and the flanges on the vertical corner studs are better concealed, further improving the appearance of the log cabin.

The present invention also eliminates the need for the angle members 37 and beading 38, shown in FIG. 5 of Australian Pat. No. 425,916. The angles 37 and beading 38 were used for placement and attachment of doors and windows into the portals between the sections of superimposed logs along the side walls of the building. In the present invention, the window and door sections are secured directly to the vertical studs by screws which pass through holes in the studs into the wooden framework of the doors and windows. This is done before the logs are superimposed over one another on the stud flanges. When the log sections of the wall are subsequently assembled, they cover the heads of the screws, assuring that the doors and windows cannot be removed.

Architrave strips are then attached around the doors and windows for concealing the studs at the sides threof. Preferably, the architraves are completed at one side of a log section before the logs are laid, and the architrave then serves as a guide for aligning the edges of the logs as they are superimposed during construction of that log section.

It is therefore an object of the present invention to provide an improved modular building structure having walls constructed of superimposed substantially horizontal elongate members; in which the members are held in position on rigid vertical structural elements by means of wedges driven into slots in the members and against the rigid vertical element interengaged with each slot; in which the elongate members are tapered and arranged in alternating fashion in some sections of the wall to accumulate their heights equally therealong, and are arranged in other wall sections with the majority of their thick ends toward the same direction to give the upper members on the wall a slant for accommodating a gabled roof thereabove; in which the horizontal elongate members have flat faces on their abutting longitudinal top and bottom sides; in which wind bracing connects various portions of the roof for squaring, rigidifying and bracing the building and roof; in which a feature window assembly may be substituted in place of one of the sections of the wall with essentially no modification of the remaining portions of the building structure; in which half-round and quarter-round logs are strategically located to conceal some of the vertical structural elements for improved building appearance; in which non-structural architrave means are provided for concealing other vertical elements and for guiding the alignment of the superimposed elongate members in the wall sections; in which a method is provided for erecting and squaring such a modular building structure; and to accomplish the above objects and purposes in an inexpensive, uncomplicated and highly durable configuration readily adapted for easy assembly and extended service life.

These and other objects and advantages of the invention will be apparent from the following description, the accompanying drawings, and the appended claims.

DESCRIPTION OF THE PREFERRED EMBODIMENT

Figure 1:
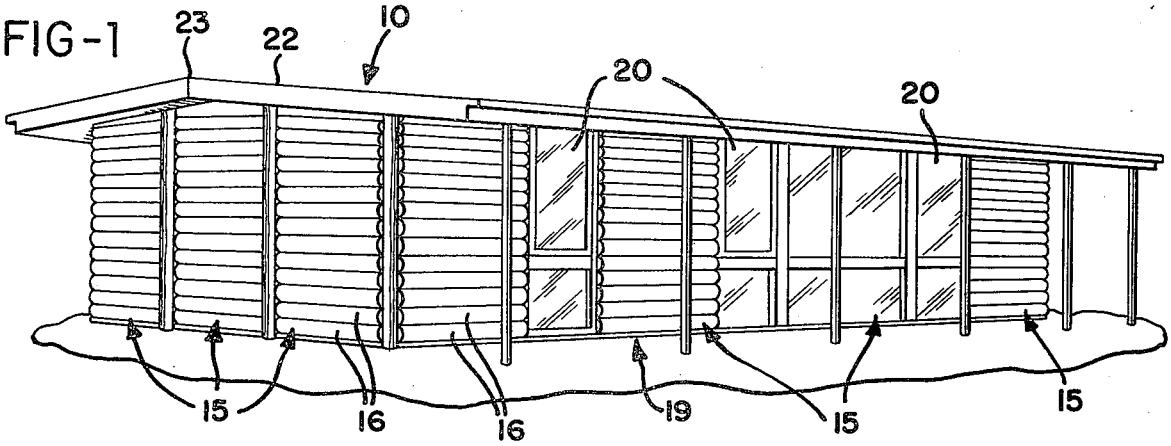
FIG. 1 is a perspective front and side view of a building constructed in accordance with the present invention.

The building structure 10 illustrated in FIG. 1 is a modular building composed of a series of wall sections 15 formed of superimposed substantially horizontal elongate members 16. The members 16 are preferrably logs of similar size, shape, and length. The ends 18 of the building are formed of adjacent wall sections 15, while the sides 19 of the building alternate between wall sections 15 and portals 20.

A gabled roof 22 extends from one end of the building to the other, with the peak 23 of the roof 22 lying over approximately the middle of the building ends 18.

Figure 2:
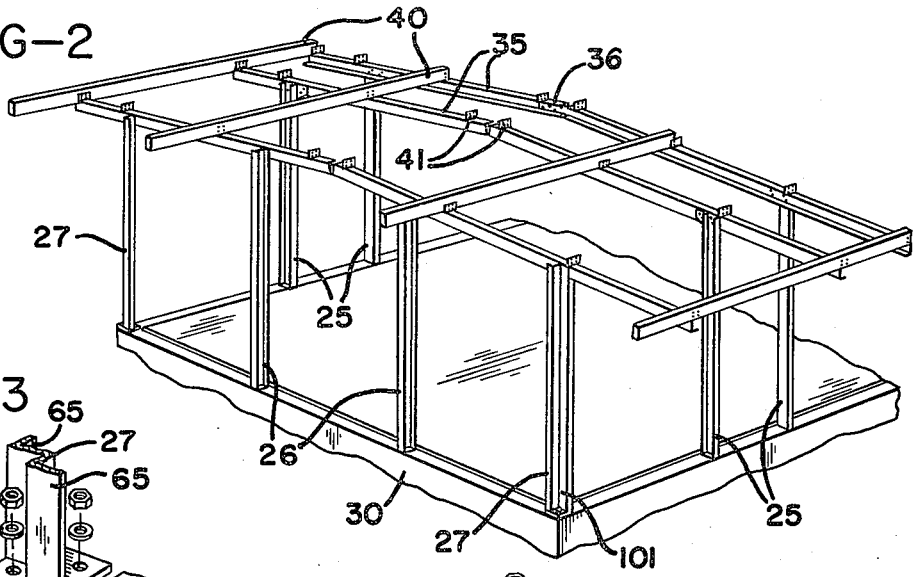
FIG. 2 is a perspective view of a portion of the framework of the FIG. 1 building.
Figure 3:
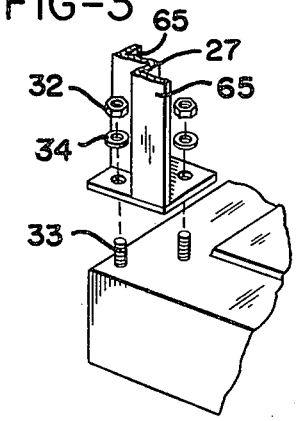
FIG. 3 is an exploded detail of the attachment of a corner framework stud to a corner of the foundation.
Figure 4:
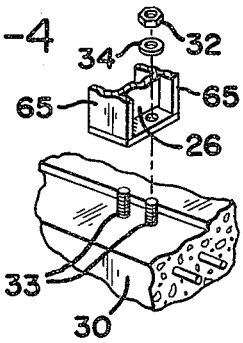
FIG. 4 is an exploded detail of the attachment of a double channel framework stud to the foundation.
Figure 6:
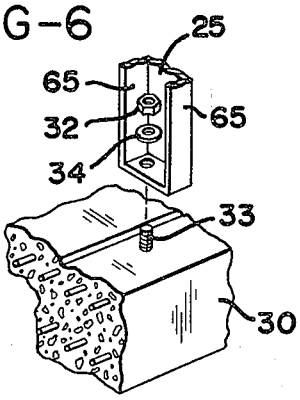
FIG. 6 is an exploded detail of the attachment of a single channel stud to the foundation.
Figure 10:
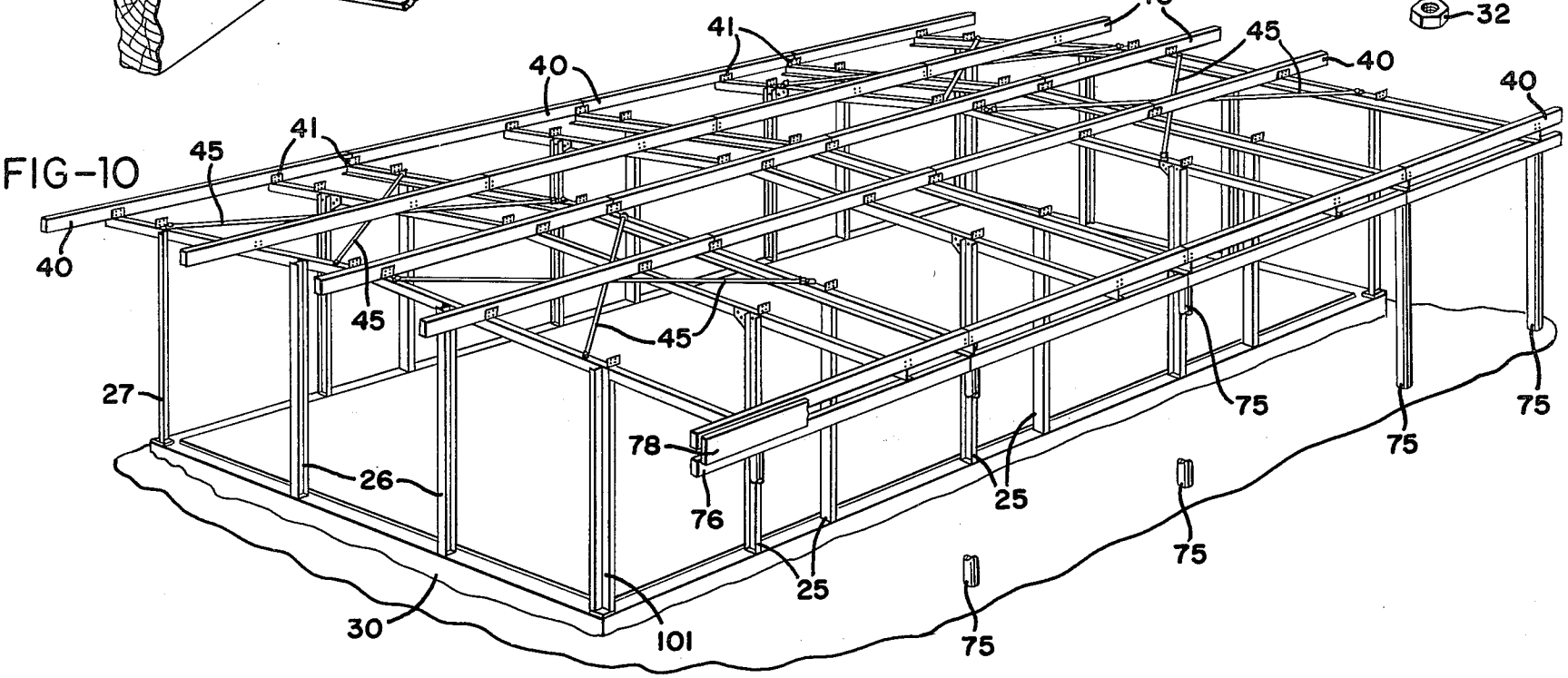
FIG. 10 is a perspective view of the FIG. 1 building structure at a later stage of construction than shown in FIG. 2, and including wind bracing connecting pairs of the rafters.

The basic structure of the building is illustrated in FIGS. 2 and 10. A series of rigid, vertical, channel-shaped studs 25 (see FIG. 6) is placed along each side 19 of the building, and similar double channel studs 26 (see FIG. 4) are placed along the building ends 18. The corners of the building structure are formed by double angle members joined at right angles to form corner studs 27 (FIG. 3). These are attached to the building foundation 30 by nuts 32, bolts 33, and washers 34, as illustrated in FIGS. 3, 4, and 6. The bolts are cast into the foundation 30. (For clarity of description, nuts, bolts, and washers will be referred to throughout by the same reference numerals 32–34. It is to be understood, however, that different sizes are illustrated and are to be used in the actual structure, according to commonly accepted practice.)

Figure 5:
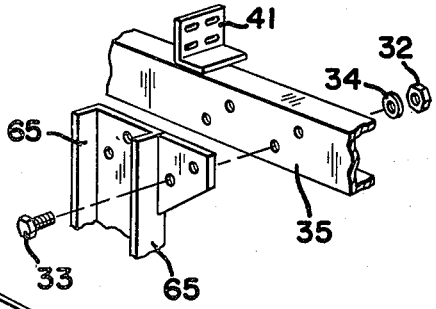
FIG. 5 is an exploded detail of the attachment of a rafter member to a single channel stud.
Figure 7:
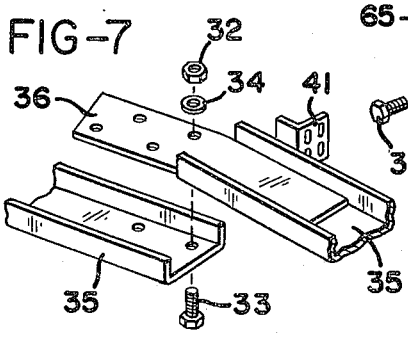
FIG. 7 is an exploded detail of the attachment of two rafter members to one another.

Rafters 35 are channel irons attached to the studs 25–27 by nuts, bolts, and washers 32–34, generally as shown in FIG. 5. Adjacent rafters 35 are attached to one another by rafter splice plates 36 (FIG. 7) welded to one of the rafters and attached to the other by nuts, bolts, and washers 32–34.

Figure 8:
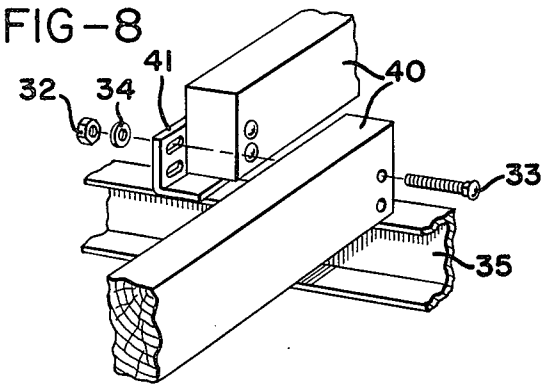
FIG. 8 is an exploded detail of the attachment of the purlins shown in FIG. 10 to the rafter members.

It has been found that the building framework is most easily erected by first erecting the corner studs 27 and double channel studs 26 at one of the building ends 18. The rafters 35 for that group of studs are then attached. The nuts, bolts, and washers which hold these members together are not tightened at this time, in order to allow the building structure to be squared once the entire structure has been erected. Next, two rafters 35 are joined and then connected to a pair of single channel studs 25. These are then lifted into upright position on foundation 30 and are joined by several purlins (2 × 4's) 40. Purlin brackets 41 are welded to the rafters 35, and the purlins are attached to the brackets 41 by nuts, bolts, and washers 32–34, as shown in FIG. 8. The purlins run from rafter to rafter generally perpendicularly to the rafters 35, as illustrated in FIG. 2.

Additional rafters 35, studs 25, and purlins 40 are then erected along the sides 19 of the building until the building framework is completed with erection of the other building end 18. At this point the various studs 25–27, the rafters 35, and the purlins 40 constitute a group of loosely attached members which are free to be adjusted relative to one another. The rafters 35 and purlins 40 form a series of parallelograms which interlock all of the rafters and permit relative movement among them.

Figure 9:
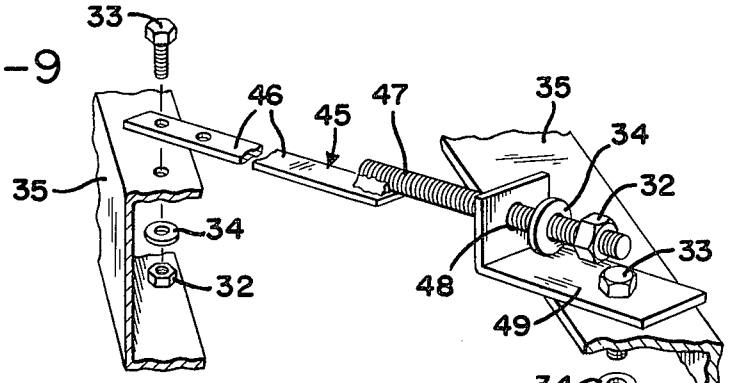
FIG. 9 is an exploded detail of the wind bracing in the FIG. 10 structure.
Figures 11, 12, 13, 19:
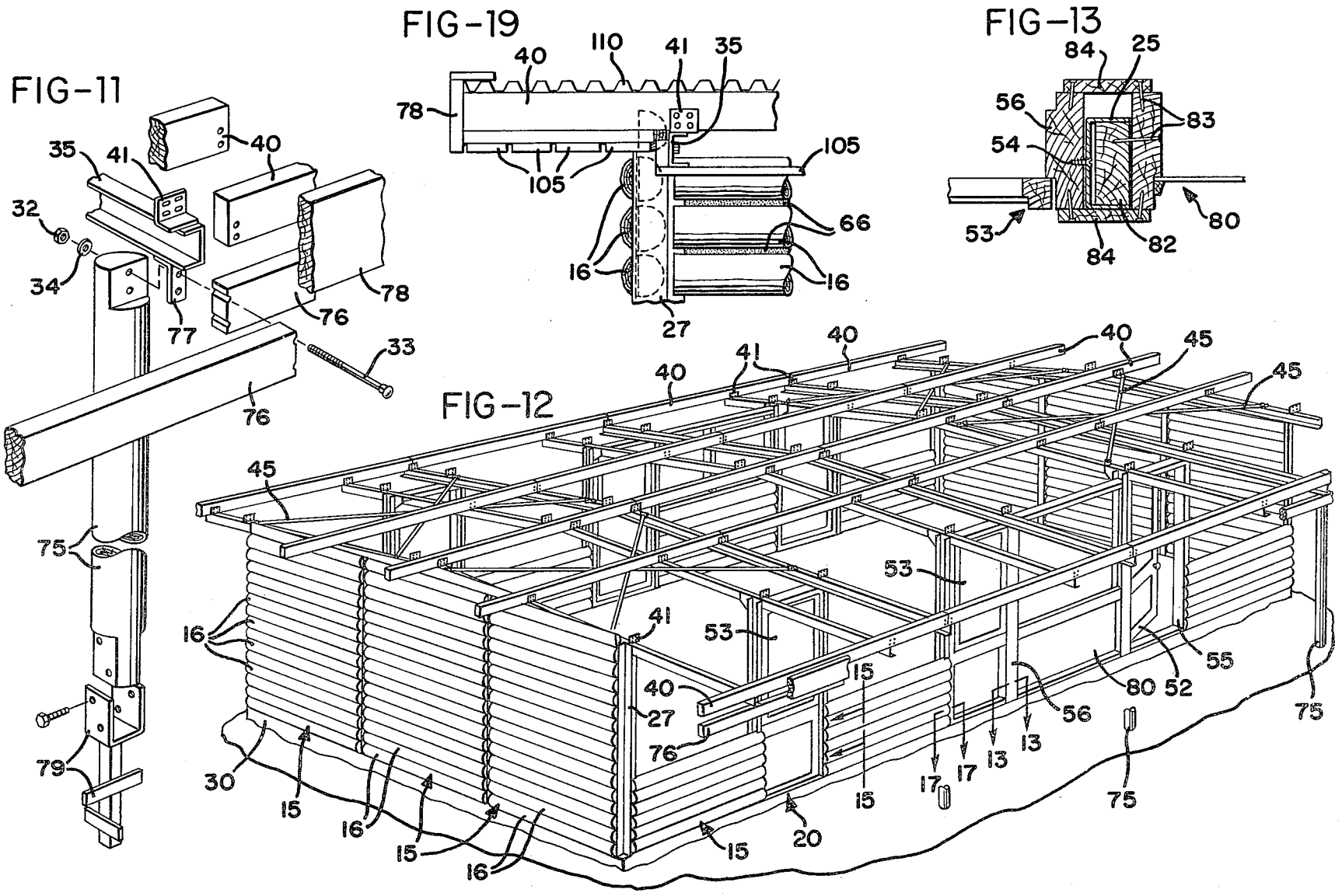
FIG. 11 is an exploded detail of the veranda posts and the adjoining roof structure.
FIG. 12 illustrates the building at a still later stage of construction, with portions omitted for clarity of illustration.
FIG. 13 is a cross sectional detail taken on line 13—13 of FIG. 12.
FIG. 19 (Sheet 3) is a side view of a portion of the completed building, with portions omitted for clarity of illustration, showing details of the eave boards beneath the roof overhang.

Pairs of the rafters 35 are then joined by diagonal bracing members 45, as illustrated in FIGS. 9, 10, and 12. These consist of a bracing strap 46 (FIG. 9) welded to a threaded bar 47 which passes through an opening 48 in a bracket 49. Bracing strap 46 is attached to one rafter 35 by nut, bolt, and washer 32–34, while bracket 49 is similarly attached to another rafter. A nut 32 and washer 34 are then threaded onto threaded bar 47 to complete the diagonal bracing 45 and to complete the attachment thereof between the rafter members 35. The effective length of each diagonal bracing member 45 may then be adjusted by turning the nut 32 on threaded bar 47 to draw or release the threaded bar 47 for movement through bracket 49.

At this point, the diagonal bracing members 45 are adjusted to pull the building structure into a squared or rectangular configuration. This is best determined by measuring the distance at the roof level from one corner stud 27 to the stud diagonally opposite across foundation 30, and comparing this with the other diagonal measurement taken with the other pair of corner studs 27. The diagonal bracing members 45 are then adjusted until the roof level diagonal measurements are equal. All nuts, washers, and bolts 32–34 are then tightened to rigidify the entire structure against further movement. Following completion of the building, the diagonal bracing members 45 function as wind bracing for bracing the building roof against high wind forces.

Figure 17:
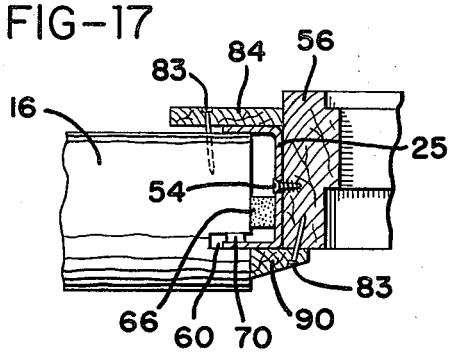
FIG. 17 is a cross sectional detail taken on line 17—17 of FIG. 12.

Each portal 20 is fitted with a portal door 52 or window 53, each of the same size. These are secured in the portals 20, as shown in FIGS. 13 and 17, by means of screws 54 passing through the single channel studs 25 into the frames 55 and 56 of the respective portal doors and windows.

Figure 15:
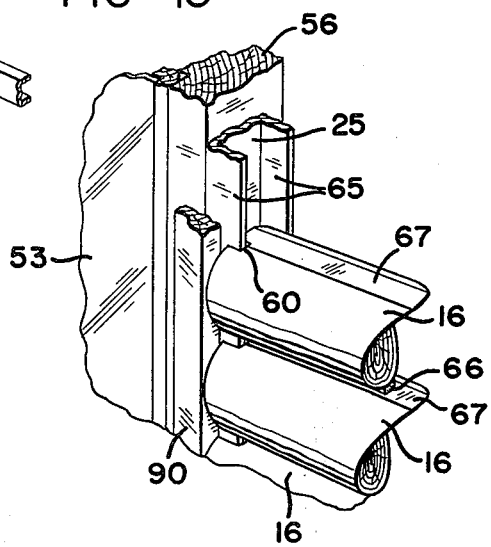
FIG. 15 is a partially broken away fragmentary view taken in the direction shown on view line 15—15 in FIG. 12.
Figure 16:
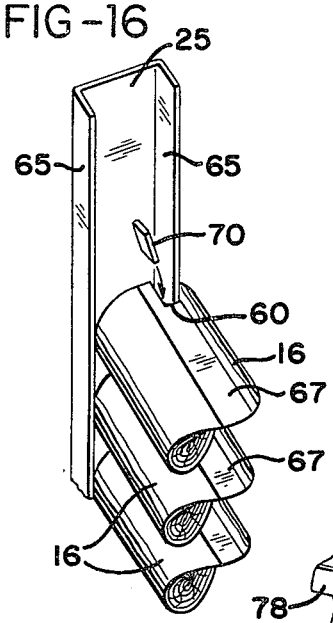
FIG. 16 is a perspective view of a channel-shaped stud member and several log members interengaged therewith, illustrating wedging of the logs thereon.

After doors 52 and windows 53 have been attached in the portals 20, the log wall sections 15 are erected. Since the specific structure of these sections is well described in Australian Pat. No. 425,916, it will be described here only briefly. As illustrated in FIGS. 15–17, each of the logs 16 is provided with a slot 60 at each end, and these slots are fitted into the flanges 65 of the various studs 25–27 to guide the logs as they are superimposed one on top of the other. Strips of compressible, resilient waterproof plastic material 66 (FIGS. 15, 17, and 19) form sealer strips which are positioned between the logs 16 and between the logs and the adjacent studs 25–27.

Since the logs are generally somewhat tapered, being thicker at one end and thinner at the other, they are preferably alternated in placement so that their heights tend to accumulate evenly along the length of each wall section 15.

On the building ends 18, however, the gabled roof 22 is sloped, so it is desirable to have the logs at the tops of the sections 15 on the building ends 18 match the slope of the roof as closely as possible. Therefore, a majority of the thicker ends of the logs 16 in the sections 15 at each side of the ends 18 are placed toward the peak 23 of the roof 22 in order to accumulate the greater heights thereof beneath the higher portions of the roof. This causes the higher logs in these sections to acquire a slant in the same direction as that of the roof above. This treatment is not given to the middle section of each building end 18 since the peak of the roof is over the middle of these sections. Were the building ends composed of an even number of wall sections 15, then all the sections would be constructed to position the thicker log ends toward the peak in order to match the slope of the gabled roof.

In the present invention, in order to improve the effectiveness of the sealer strips 66 and to improve the appearance of the wall sections 15, each of the logs 16 has a flattened face 67 on the abutting longitudinal top and bottom sides thereof (see FIGS. 15 and 16). These flattened faces 67 tend to even out irregularities along the logs so that they abut each other uniformly from end to end. This also increases the transverse extent of the contact between the logs and tends to confine better the sealer strips 66, further improving the appearance of the walls. Previously, the strips 66 have sometimes been rather prominent wherever irregularities in the logs caused large spaces to appear. By placing the strips 66 along the flattened log faces 67, such problems have been minimized.

FIGS. 16 and 17 illustrate wedges 70 which are driven into the slots 60 and against the flanges 65 to wedge and fix the positions of the logs on their corresponding studs 25–27. But for the wedges 70, the logs would be free to move upwardly and downwardly upon the flanges 65 as their dimensions changed in response to such factors as seasonal weather variations. The wedges 70 prevent such movement so that changes in the log dimensions are distributed uniformly among the resilient sealer strips 66.

FIGS. 10–12 illustrate details of the attachment of the optional veranda posts 75. A veranda beam 76 is attached beneath the purlins 40 and beneath the rafters 35 by means of veranda beam brackets 77 which are bolted to the rafters 35. These are all connected by means of nuts, bolts, and washers 32–34 which also pass through the tops of the veranda posts 75, as illustrated in FIG. 11. A facia board 78 is then nailed over the purlin 40 and veranda beam 76. A veranda anchor 79 secures the bottom of the veranda post 75 in the ground.

As mentioned earlier, and as shown in FIGS. 1, 2, 10, and 12, the width of the building is equal to the three wall sections 15 on the end 18 of the building 10. The length of the building along sides 19 is equal to the sum of the alternating wall sections 15 and portals 20 therealong. Of course, any size building may be constructed according to the present invention, but the preferred embodiment is a standardized, modular structure in which the width of all of the buildings is always the same, such as the three sections 15 on the building ends 18. However, the length of each building may be made as short or as long as desired simply by extending the modular sequence of the identical single channel studs 25 and rafters 35 as far as desired, to provide additional alternating wall sections 15 and portals 20 along the building sides 19.

Sometimes it is desired to have additional window area in these buildings. Due to their modular construction, it is possible to omit any of the wall sections 15 and provide some other feature, such as a fireplace or a feature window, in place thereof. The present invention provides a feature window 80 which may be readily and easily substituted in place of any wall section 15.

When a substitution is made for a wall section, it is best that it require essentially no alteration of the basic structure of the building. There are substantial economic advantages in being able to retain the modular approach to a building of this type, since this permits standard components to be used throughout while also allowing individualization of the structure to the greatest possible extent.

Figure 14:
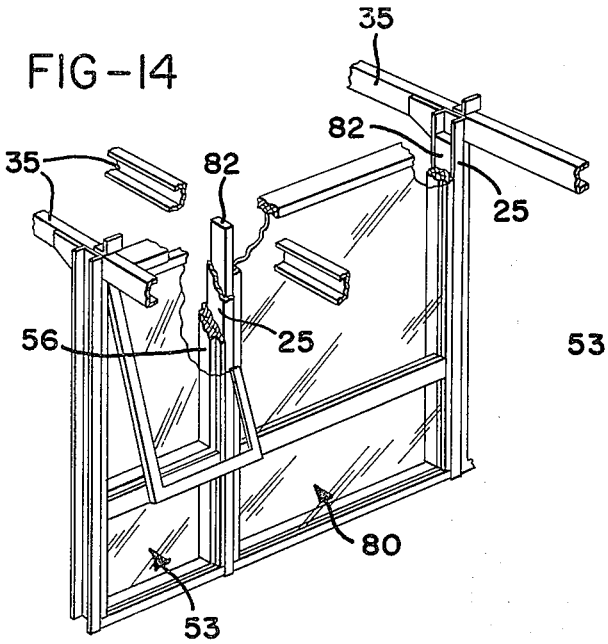
FIG. 14 is a partially broken away perspective view of portal and feature windows in the building.

The feature window 80 of the present invention is therefore adapted for use with the existing single channel studs 25 appearing at each side of the wall section in which the window is to be placed. Timber inserts 82 (FIGS. 13 and 14) are inserted into the single channel studs 25 to fill these channels, which face the section in which the feature window 80 will be fitted. Window 80, which is slightly less in width than this section, is then placed into the section and secured therein, as by nails 83 (FIG. 13). Window 80 is of a width to hold the timber inserts 82 in the channels, and the timber inserts, in turn, hold the feature window 80 in place since the inserts are secured in the channels. As indicated, this substitution is thus readily made with no alteration to the basic structure of the building itself.

For the sake of appearance, facing strips 84 are nailed onto the frames of the feature window 80 and portal door or window 52 or 53 on either side thereof, as shown in FIG. 13, to finish the appearance by enclosing and thus concealing the structural single channel stud 25 therebetween. With reference to FIG. 17, similar facing strips 84 are applied over the single channel studs 25 on the inside of the building to finish the appearance thereof at the edges of the wall sections 15 maade up of the superimposed logs 16.

The ends of the log sections on the outside of the building 10 are fitted with non-structural architraves 90 which frame the adjacent portal members 52 and 53 and conceal the channel studs thereadjacent. Preferably, an architrave strip 90 is positioned at one side of a wall section 15 before the logs 16 are stacked therein. This architrave then serves as a guide (see FIG. 15) for aligning the ends of the logs as they are superimposed one upon another when the wall section is being constructed. This provides a simple and convenient means for aligning the logs. When a section 15 is completed, the architrave 90 at the other side is then nailed into position.

Figure 18:
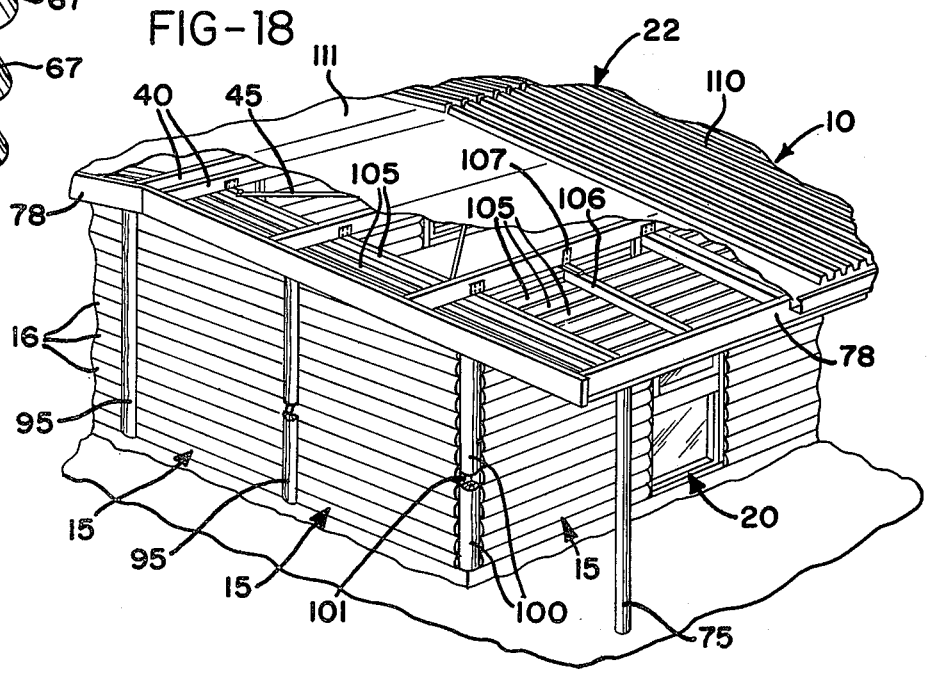
FIG. 18 is a partially broken away perspective view of a portion of the completed building structure.

Facing strips 84 and architraves 90 are not used on the corners and ends of the building. Instead, the double channel studs 26 on the building ends 18 are concealed by means of half-round logs 95 (FIG. 18) mounted vertically adjacent the ends of the logs 16 engaged with the double channel studs. The half-round logs are positioned to cover the ends of the logs in order to conceal the double channel studs 26 and to improve the appearance of the building. Quarter-round logs 100 (FIG. 18) are mounted vertically into the rectangular space 101 formed in the corner studs 27 to help conceal them and to improve the appearance of the building structure.

The eaves are then completed by nailing eave boards 105 to the purlins 40 and to eave hangers 106 suspended from the purlins 40 and rafters 35 by appropriate eave hanger brackets 107. A conventional roof may then be applied, such as the corrugated roof 110 (FIG. 18) having a waterproof plastic material 111 therebeneath. Any other appropriate roofing and/or ceiling construction may be used as desired.

As may be seen, therefore, the present invention provides numerous advantages. It may be constructed throughout with a minimum number of standard components, yet a maximum of versatility obtains, permitting each building to be customized according to the desire of each individual builder.

Construction is uncomplicated and straightforward. The standardized, modular approach permits a building of even substantial size to be constructed with a minimum of time and effort. Yet, by the use of durable, weather resistant materials, the building is exceptionally strong and provides a long, useful life.

While the form of building structure herein described constitutes a preferred embodiment of the invention, it is to be understood that the invention is not limited to this precise form, and that changes may be made therein without departing from the scope of the invention.

What is claimed is:

1. In a building structure having a wall constructed of a set of superimposed substantially horizontal elongate timber members, each said elongate member having a transverse slot in at least one end, said transverse slots being arranged in vertical alignment, a rigid vertical element interengaged with said slots to hold said superimposed elongate members in position, and strips of compressible waterproof material sandwiched between said superimposed elongate members to form weather seals between them, the improvement comprising:

wedge elements driven into at least some of said slots and against said vertical element therein to wedge and fix the positions of the corresponding said elongate members on said vertical element to improve the seasonal stability of the structure and to prevent shrinkage or expansion movements of said elongate members from accumulating throughout said set of superimposed elongate members.

2. The building structure of claim 1 further comprising:

means providing flattened faces on the abutting longitudinal top and bottom sides of said elongate members to improve the effectiveness and uniformity of the weather seals formed between said elongate members by said strips of waterproof material sandwiched therebetween, and to aid the appearance of the wall by helping to compress said strips more uniformly.

3. In a building structure having a wall constructed of a set of superimposed substantially horizontal elongate members, each said elongate member having a transverse slot in at least one end, said transverse slots being arranged in vertical alignment, and a rigid vertical element interengaged with said slots to hold said superimposed elongate members in position, the improvement comprising:

said horizontal elongate members each being of greater height at one end than the other and being superimposed in generally alternating fashion so that the heights of said members tend to accumulate equally along the length of the wall.

4. In a building structure having a gabled roof, at least one of the walls on one of the gabled sides of the structure including a set of superimposed substantially horizontal elongate members, each said elongate member having a transverse slot in at least one end, said transverse slots being arranged in vertical alignment, and a rigid vertical element interengaged with said slots to hold said superimposed elongate members in position, the improvement comprising:

said horizontal elongate member each being of greater height at one end than the other, and the majority of said one ends of said members being positioned toward the peak of the gabled roof to accumulate the greater heights thereof beneath the higher portions of the roof, the higher said members on the wall thus acquiring a slant in the same direction as that of the roof above.

5. In a modular building structure having a series of wall sections each constructed of a set of superimposed substantially horizontal elongate members, each said elongate member having a transverse slot in at least one end, said transverse slots in each section being arranged in vertical alignment, and a rigid channel shaped vertical element for each section having a channel facing said elongate members and a channel flange adjacent said channel, said channel flange being interengaged with said slots to hold said superimposed elongate members in position, the improvement comprising:

a. a feature window assembly in the place of one of said wall sections, b. said feature window assembly being slightly less in width than the corresponding wall section, c. channel filling means for filling said channel facing said feature window, d. means securing said feature window assembly to said channel filling means, and e. said feature window assembly being of a width to hold said channel-filling means in said channel and thereby to secure said channel filling means and said feature window assembly in place in the corresponding wall section of the building structure.

6. In a modular building structure having a series of wall sections each constructed of a set of superimposed substantially horizontal elongate members of substantially equal lengths, each said elongate member having a transverse slot in at least one end, said transverse slots in each section being arranged in vertical alignment, a rigid vertical element for each said section interengaged with said slots therein to hold said superimposed elongate members in position, and a series of portals alternating with said wall sections along at least a portion of one side of the building structure, the improvement comprising:

a. a portal member in each said portal, b. retainer means passing through portions of said rigid vertical elements at the sides of said portals and engaging said portal members to secure said portal members in said portals, and c. non-structural architrave means framing at least one of said portal members, concealing said rigid vertical element at the edge of said portal, and serving as a guide for aligning the ends of said superimposed elongate members at the edge of said portal.

7. In a building structure having a roof and a pair of side walls each constructed of a series of rigid vertical elements and between at least two of said rigid vertical elements a set of superimposed substantially horizontal elongate members, each elongate member having a transverse slot in each end, said transverse slots being arranged in vertical alignment at each end of the set and interengaged with said two rigid vertical elements to hold said superimposed elongate members in position, the improvement comprising:

a. said rigid vertical elements forming studs for supporting the roof of the building, b. rafter means forming a portion of the roof and extending between the studs in one said side wall and the studs in said other wall so as to be supported by said studs, c. first attachment means for attaching said rafter members to said studs and capable of initial loose attachment and subsequent tightening to provide rigid attachments, d. purlins extending transversely between said rafter members, e. second attachment means for attaching said purlins to said rafter members and capable of initial loose attachment and subsequent tightening to provide rigid connections, f. wind bracing for connection between adjacent rafter members at each end of the building for squaring the building and rigidifying and bracing the roof, and g. third attachment means for attaching said wind bracing to the respective rafter members and for adjusting the effective length of said wind bracing to permit drawing and pulling the building to a squared condition with said first and second attachment means providing loose connections, and for rigidifying and bracing the building and roof in this condition prior to tightening of said first and second attachment means to provide rigid connections.

8. The building structure of claim 7 wherein:

a. said rafter member comprises a metallic member, b. said first attachment means comprises adjustable nut and bolt means providing for initial movement between said rafter member and stud, and for subsequently resisting such movement upon tightening of said nut and bolt means, c. said wind bracing comprises a diagonal member, and d. said second attaching means comprises adjustable nut, threaded bar, and bracket means, said threaded bar being drawable through said bracket by said nut to shorten the effective length of said wind bracing.

9. The building structure of claim 7 further comprising:

a. wooden purlins for the roof of the building, and b. adjustable nut and bolt means for adjustably attaching said purlins to said rafter member.

* * * * *